US007624458B2

(12) United States Patent
Felling

(10) Patent No.: US 7,624,458 B2
(45) Date of Patent: Dec. 1, 2009

(54) PERSONAL TRANSFER AND CARRIER SLING

(76) Inventor: Mark Felling, 15382 80th Pl. North, Maple Grove, MN (US) 55311

( * ) Notice: Subject to any disclaimer, the term of this patent is extended or adjusted under 35 U.S.C. 154(b) by 139 days.

(21) Appl. No.: 11/673,305

(22) Filed: Feb. 9, 2007

(65) Prior Publication Data

US 2008/0189853 A1 Aug. 14, 2008

(51) Int. Cl.
*A61G 1/013* (2006.01)

(52) U.S. Cl. ..... 5/81.1 T; 5/89.1; 5/627; 294/140

(58) Field of Classification Search ..... 5/89.1, 5/625–628, 81.1 T; 294/140
See application file for complete search history.

(56) References Cited

U.S. PATENT DOCUMENTS 3,234,568 A * 2/1966 Fischer ..... 5/89.1
3,701,395 A * 10/1972 Theobald ..... 182/3
4,553,633 A 11/1985 Armstrong et al.
4,580,372 A 4/1986 Osborn
4,723,327 A 2/1988 Smith
4,981,307 A 1/1991 Walsh
5,297,834 A 3/1994 Vanarnem
5,388,551 A 2/1995 Martusciello
5,530,975 A * 7/1996 Firebaugh et al. ..... 5/81.1 T
5,579,546 A 12/1996 Griskauskas
5,787,529 A * 8/1998 Landes ..... 5/628
6,122,778 A 9/2000 Cohen
6,154,899 A 12/2000 Brooke et al.
6,276,006 B1 8/2001 Hoit
6,289,534 B1 * 9/2001 Hakamiun et al. ..... 5/89.1
2003/0192118 A1 * 10/2003 Carbonneau et al. ..... 5/89.1

FOREIGN PATENT DOCUMENTS

JP 20005233 1/2000

OTHER PUBLICATIONS

Product information, "Tuk-'N-Kari™" transfer sling, www.tuknkari.com, 5 pp., accessed Apr. 9, 2008.
Product information, "Garaventa Evacu-Trac CD7-Evacuation Chair," www.evacutrac.com, 2 pp., accessed Apr. 9, 2008.
"Patient Lifter Slings: The critical connection between patient and lift," Just-Patient-Lifters.com, T.H.E. Medical, 4 pp., 2002.
Product List and Description-Evacuation Aids, Sunnyfield Supplies Ltd., www.sunnyfieldsupplies.com, 2 pp.
Product List and Description-Mobility Aids, Sunnyfield Supplies Ltd., www.sunnyfieldsupplies.com, 3 pp.
Stryker EMS Equipment-Stair Chairs; Stair-PRO Model 6252, www.stryker.com, 1 pp., 2004-2006.
RedBarn Enterprises-Therapeutic Solutions Within Your Grasp; Lovehandles, www.redbarn-enter.com, 1 pp., 2004.

* cited by examiner

*Primary Examiner*—Michael Trettel
(74) *Attorney, Agent, or Firm*—Faegre & Benson, LLP

(57) ABSTRACT

In one embodiment, the invention is a personal transport device comprising a back support and two leg flaps extending from a bottom edge of the back support. The leg flaps are configured to cross under and support a thigh region of a person. Two upper handles are located on the back support and two lower handles are located on a leg flap. Another embodiment of the invention is a method of lifting a person using a personal transport device.

22 Claims, 5 Drawing Sheets

PERSONAL TRANSFER AND CARRIER SLING

TECHNICAL FIELD

The present invention relates to devices used to transport and carry persons having limited mobility. The present invention more particularly relates to a non-mechanized carrier sling used to transfer a person having limited mobility.

BACKGROUND

Persons of limited mobility, such as paraplegics, quadriplegics, and those suffering from diseases or conditions such as muscular dystrophy, multiple sclerosis, ALS, and cerebral palsy, typically encounter difficulties when faced with a situation where they must be transferred from one location to another, such as from a wheelchair seat to an airplane seat, a car seat, or a recreational seat (e.g., a kayak or sit ski seat). Additionally, in emergency evacuation situations, it can be difficult to evacuate wheelchair-bound or injured persons from any multi-story building, particularly from skyscrapers or other buildings requiring evacuation down multiple flights of stairs.

Transfer devices for transporting such persons from one location to another and emergency evacuation devices currently exist. These transfer devices are typically mechanical lifts and/or slings that require trained operators and heavy mechanical equipment to use. Similarly, such emergency evacuation devices are typically heavy, rigid devices that are difficult to use in emergency situations, particularly by untrained personnel. They are rarely available when needed due to their size and the difficulty in storing such devices. These transfer and emergency evacuation devices also fail to adequately secure the person being transported in the device. Thus, there is a need in the art for a personal transfer and carrier device that is lightweight and can be used by unskilled operators. There is a further need in the art for a personal transfer and carrier device that maintains the person being transported in a stable position during use.

SUMMARY

In one embodiment, the invention is a personal transport device comprising a back support and two leg flaps extending from a bottom edge of the back support. The leg flaps are configured to cross under and support a thigh region of a person. Two upper handles are located on the back support and two lower handles are located on a leg flap.

In another embodiment, the invention is a personal transport device comprising a flexible support material having a back support region and a plurality of leg extensions. Each leg extension is adapted to extend from a first side of a person's thigh region to a second side of the thigh region, thereby crossing under and supporting the thigh region.

In another embodiment, the invention is a method of lifting a person using a device having a back support region and a plurality of leg extensions adapted to cross under and support a thigh region of the person. The method comprises positioning the back support region adjacent to a back of the person. The leg extensions are pulled and crossed so that each leg extension extends from a first side of a person's thigh region to a second side of the thigh region, thereby crossing under and supporting the thigh region. Application of an upward force to the back support and to each leg extension lifts the person.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
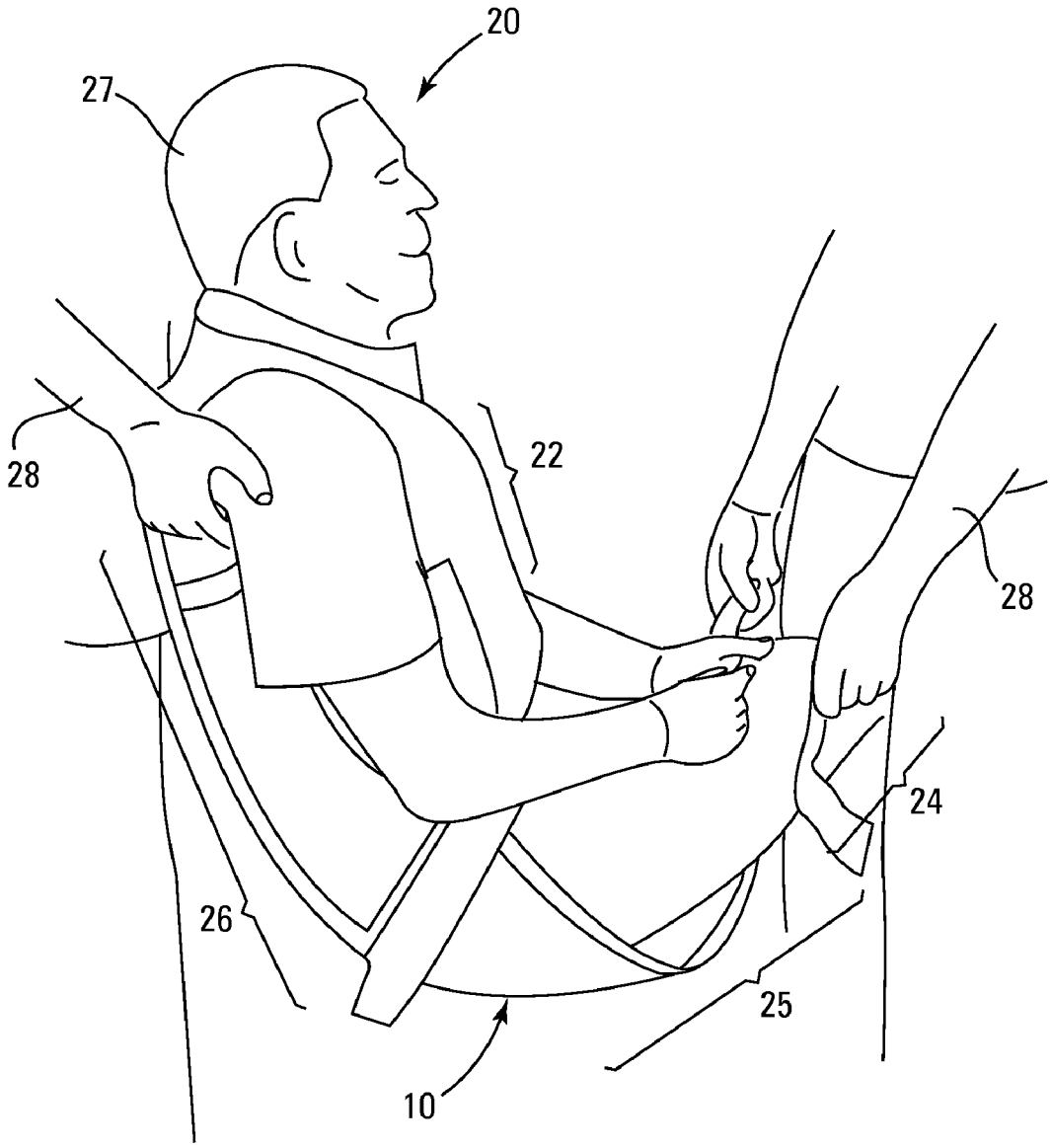
FIG. 1 is a side schematic view of a person positioned in a personal transfer and carrier sling according to one embodiment of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 is a side view of a personal transfer and carrier sling 10 according to one embodiment of the present invention. A person 20 is seated in and supported by the personal transfer and carrier sling 10. The person 20 has a torso 22, a knee region 24, a thigh region 25, a back 26, and a head 27. As shown in FIG. 1, the sling 10 supports the person 20 in a seated position, while lifted by two lifting persons 28. In the illustrated embodiment, the lifting persons 28 are positioned at the back 26 and knee region 24 of the person 20, but in other embodiments, the lifting persons 28 could be positioned in different locations.

Figure 2:
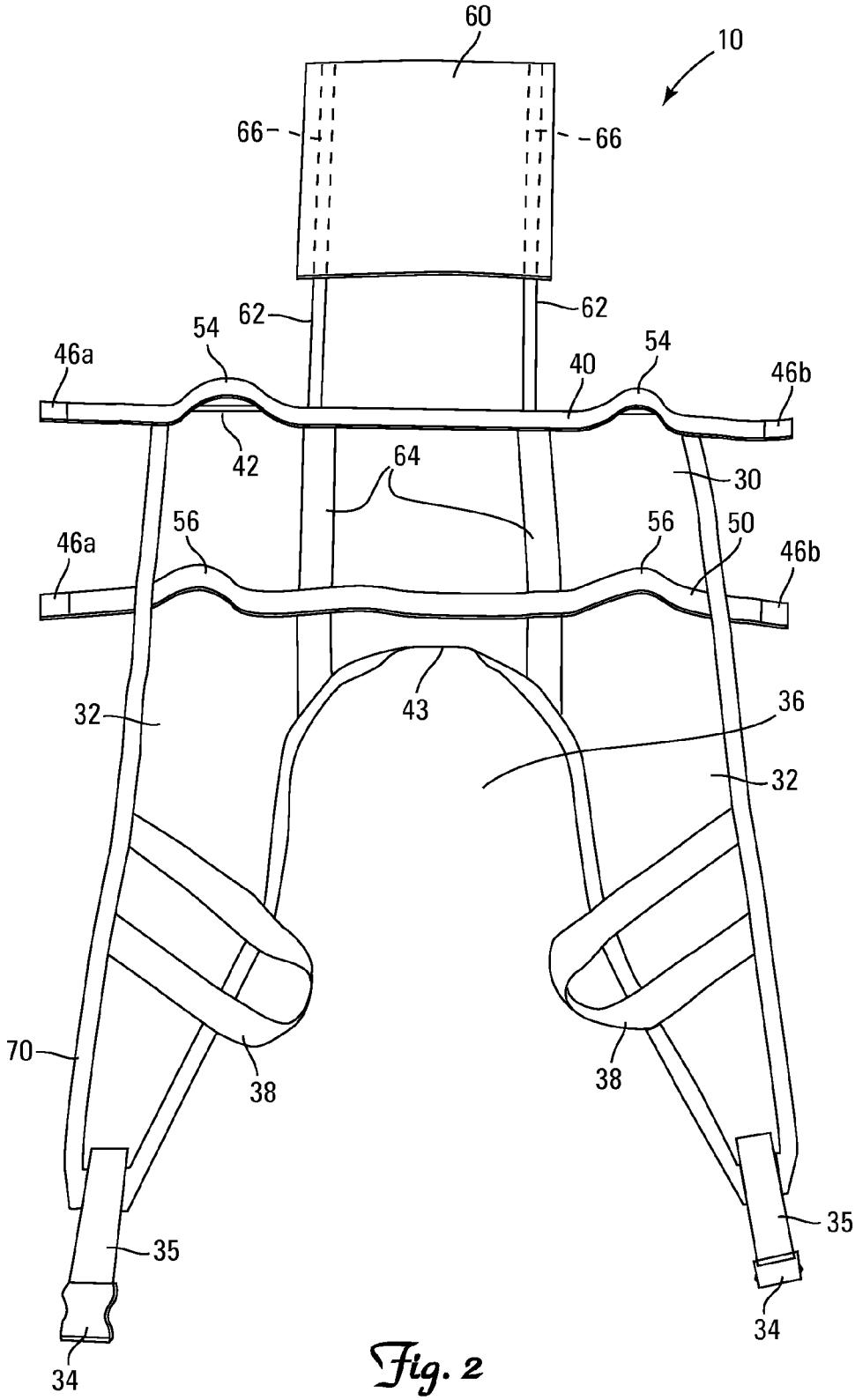
FIG. 2 is a back view of a personal transfer and carrier sling according to one embodiment of the present invention.

FIG. 2 is a back view of the personal transfer and carrier sling 10 in an open position to allow the details of the sling 10 to be more easily seen. As shown in FIG. 2, the sling 10 includes a back support region 30, leg extensions or flaps 32 extending from the back region 30, an open seat region 36 located between the leg flaps 32, and a headrest 60. The back support region 30 is configured to support the person's back 26 while being lifted and carried. In one embodiment, the back support region 30 has a height of between approximately 16 and approximately 19 inches. In one embodiment, the back support region 30 has a width of between approximately 23 and approximately 25 inches.

In one exemplary embodiment, the body of the sling 10 can be made from a flexible support material, such as a treated canvas material that is resistant to snags, wrinkles, and twists. In alternative embodiments, the sling 10, or portions of the sling 10, such as the headrest 60 or back support region 30, can comprise a rigid material. In one embodiment, the sling 10 includes edging 70 that reinforces portions of or all of the outside edges of the sling 10, thereby preventing snagging and tearing of the outside edges. In one embodiment, the edging 70 can be made of a nylon webbing.

The leg flaps 32 are configured to cross under and support the thigh region 25 of the person. In the illustrated embodiment, the leg flaps 32 include fasteners 34 and lower handles 38. In one exemplary embodiment, as shown in FIG. 2, the fasteners 34 are coupled to the leg flaps 32 by a strap 35. In one embodiment, the strap 35 has a length of about 18 inches when buckled. The fasteners 34 can be used to mechanically couple the leg flaps 32 together when lifting the person 20. In the illustrated embodiment, the fasteners 34 comprise buckles, but in other embodiments, the leg flaps 32 include any other kind of fastener or fasteners known in the art, for example, Velcro, hook and loop fasteners, and ties. In another embodiment, the leg flaps 32 do not include mechanical fasteners. In one embodiment, the leg flaps 32 have a length of between approximately 25 and approximately 28 inches. In one embodiment, the leg flaps 32 have a width of between approximately seven and approximately ten inches.

The lower handles 38 have a size that allows a lifting person 28 to fit all or a portion of a hand through the handle 38. In the embodiment shown in FIG. 2, the handles 38 comprise a separate handle coupled to the leg flaps 32. In other embodiments, the handles 38 can comprise an opening, slit, or hole in the leg flaps 32. In one embodiment, the handles 38 can comprise a nylon webbing material. In other embodiments, the handles 38 can comprise any other material that can couple to the leg flaps 32 and support the weight of the person 20.

As shown in FIG. 2, an open seat region 36 is interposed between the leg flaps 32. In other embodiments, the sling 10 does not include an open seat region. The open seat region 36 facilitates positioning of the sling 10 around the person 20 and facilitates removal of the sling 10. It also allows the person 20 to wear the sling 10 while in a seated position with a reduced risk of pressure sores. In one embodiment, the open seat region 36 has a width of between approximately 13 and approximately 15 inches.

As shown in FIG. 2, a first strap 40 and a second strap 50 are located on the back support region 30 and are configured to encircle the torso 22. The first strap 40 is shown located near a top edge 42 and the second strap 50 is shown located near a bottom edge 43 of the back support region 30. In other embodiments, the straps 40, 50 can be located on any other area of the back support region 30. In one embodiment, the straps 40, 50 are made from a nylon webbing. The straps 40, 50 include fasteners 46 adapted to mechanically couple to each other when the sling is positioned to transfer and carry the person 20. In the embodiment shown in FIG. 2, the fasteners 46 comprise buckles, but in other embodiments, the straps 40, 50 include any other kind of fastener or fasteners known in the art. For example, the fasteners 46 can be Velcro, hook and loop material, metal buckles, or ties.

In one embodiment, the length from the fastener 46*a* to the fastener 46*b* is between approximately 54.5 and 56.5 inches. In another embodiment, the length from the fastener 46*a* to the fastener 46*b* is any length required to encircle the torso 22. In one embodiment, the fasteners 46 are readily adjustable along the strap 40, 50, such that the straps 40, 50 may be tightened to snugly fit the person's torso 22. In yet another embodiment, the carrier 10 does not include the first strap 40 or alternatively does not include the second strap 50.

In the embodiment illustrated in FIG. 2, the sling 10 includes upper handles 54. As shown, the upper handles 54 are located at the top edge 42 of the back support region 30 and are integral with the first strap 40. In another embodiment, the upper handles 54 can be located anywhere on the back support region 30 and can be integral with or separate from the first strap 40. In the illustrated embodiment, the sling 10 includes middle handles 56 integral with the second strap 50. In another embodiment, the middle handles 56 are interposed in any region between the upper handles 26 and the leg flaps 32. In one embodiment, the middle handles 56 are separate from the second strap 50.

As discussed with respect to the lower handles 38, the upper and middle handles 54, 56 can comprise an opening, slit, or hole in the back support region 30. The handles 54, 56 can comprise a nylon webbing material. In other embodiments, the handles 54, 56 can comprise any other material that can support the weight of the person 20. In other embodiments, the sling 10 can include any combination of straps 40, 50 and handles 38, 54, 56 desired.

In the embodiment shown in FIG. 2, the sling 10 includes a headrest 60. In the illustrated embodiment, supports or staves 62 extend from the back support region 30 to the headrest 60. The supports 62 extend from underneath back support reinforcing strips 64 and slide into pockets 66 of the headrest 60. As the person 20 is lifted, the person's back 26 pushes against the supports 62, thereby forcing the headrest 60 forward to support the head 27. In one exemplary embodiment, the supports 62 comprise a semi-rigid plastic. In one embodiment, the supports 62 have a width of approximately 1 inch and a thickness of approximately ⅛th inch. In one embodiment, the supports 62 have a length of between approximately 28 to 36 inches. In one embodiment, the headrest 60 has a length of approximately 18 inches and a width of approximately 14 inches. The headrest 60 and the supports 62 can have any dimensions that support the head 27. In one embodiment, the headrest 60 is integral with the back support region 30. In another embodiment, the sling 10 does not include a headrest 60.

Figure 3:
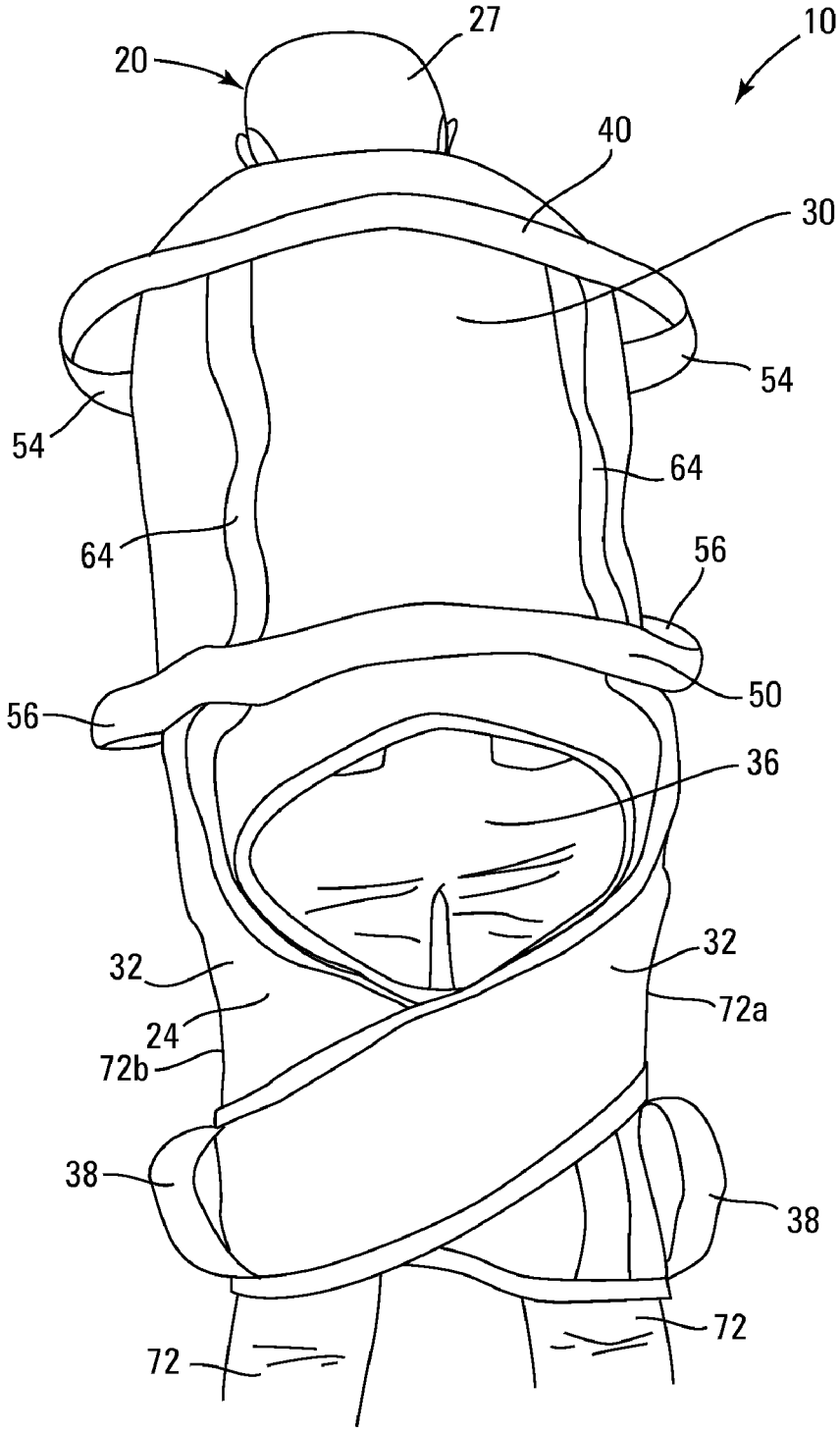
FIG. 3 is a back view of a person positioned in the personal transfer and carrier sling according to one embodiment of the present invention.

FIG. 3 is a back view of the sling 10 positioned to transfer and carry the person 20. As shown in FIG. 3, each leg flap 32 extends under the thigh region 25 from a first side 72*a* to a second side 72*b* of the thigh region 25, thereby crossing under and supporting the thigh region 25. The sling 10 maintains the person 20 in a seated position while securing the thigh region 25 during transfer. It allows for easy repositioning of the person 20 in a seat and reduces the possibility of torn clothing or accidentally dislodged or disconnected urinary collection devices. As shown in FIG. 3, the leg flaps 32 also form an open seat region 36, which can minimize pressure sores.

Figure 4:
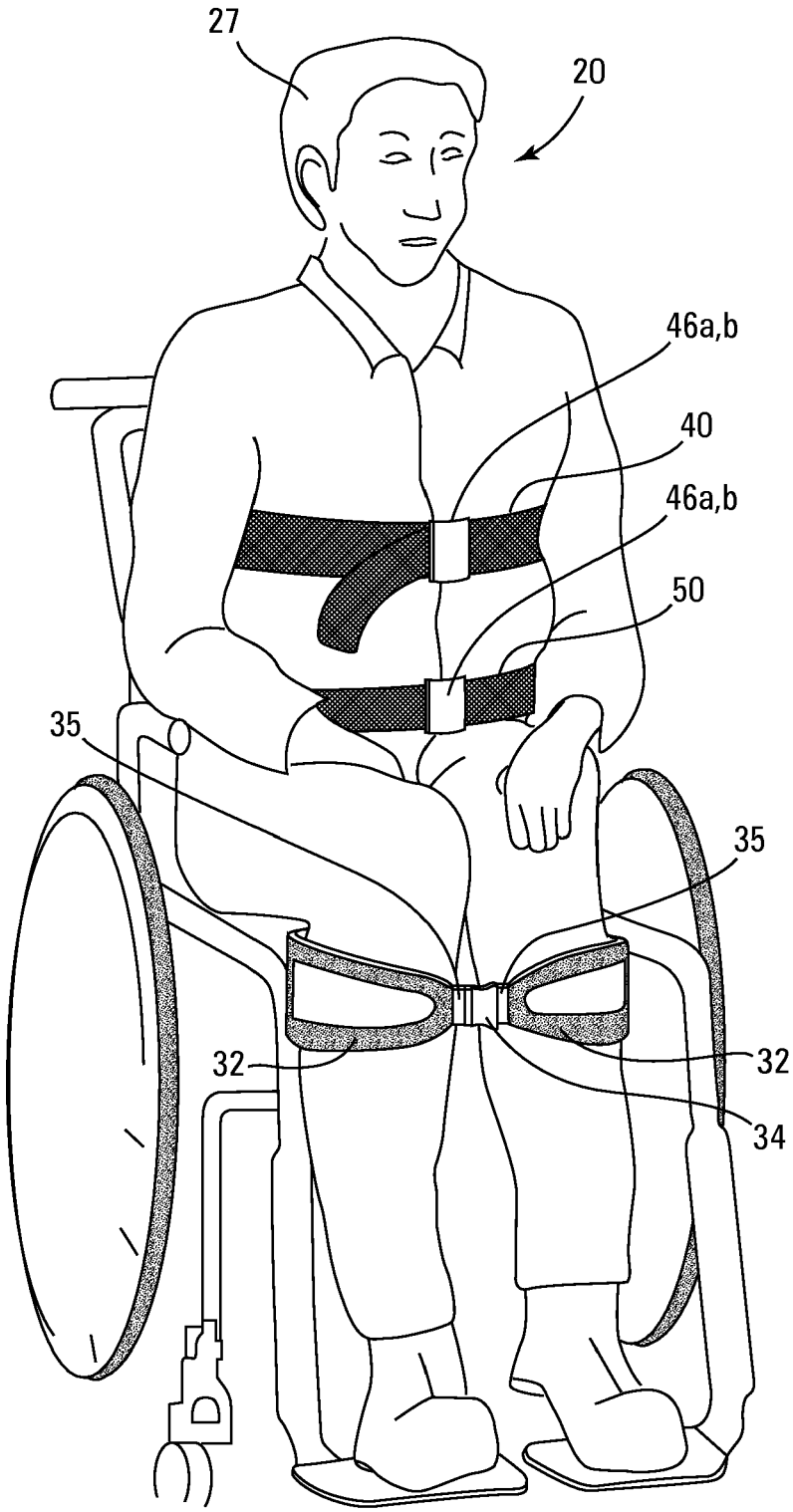
FIG. 4 is a schematic view of a person positioned in the personal transfer and carrier sling and sitting in a wheelchair according to one embodiment of the present invention.

FIG. 4 is a schematic view of the person 20 wearing the sling 10 and positioned in a wheelchair. As shown in FIG. 4, the first and second straps 40, 50 are fastened in front of the person 20 using buckles 46*a*, 46*b*. The leg flaps 32 extend and cross under the person 20 and emerge generally lateral to the knee joint. The straps 34 are coupled using the buckle 35, at a position just below the knees.

Figure 5:
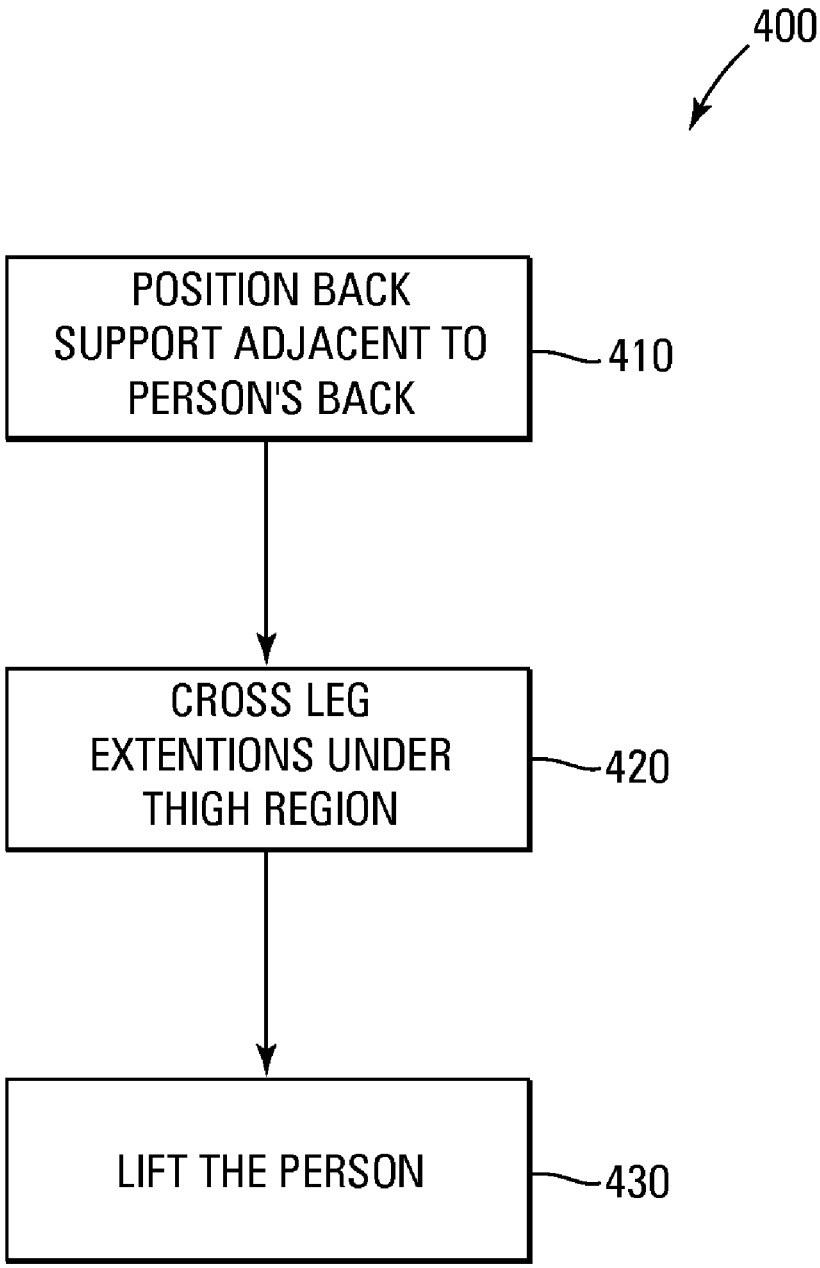
FIG. 5 is a flowchart of an exemplary method of using the personal transfer and carrier sling according to one embodiment of the present invention.

FIG. 5 illustrates one exemplary method 400 of lifting the person 20 using the sling 10. First, the back support region 30 is positioned adjacent the back 26 of the person 20 (block 410). The leg flaps 32 are then pulled and crossed under the thigh region 25 such that each leg flap 32 extends generally across a lateral portion of a gluteal region and then transversely under an upper hamstring area of a first leg and across a lower hamstring area of the other leg emerging generally lateral to the knee joint (block 420). The person 20 is then lifted using the sling by applying an upward force to the back support region 30 and both leg flaps 32 (block 430). In another embodiment, the method 400 further comprises mechanically coupling the leg flaps 32 together using the fasteners 34. In one embodiment, the leg flaps 32 are coupled together adjacent the knee joint. The method 400, in yet another embodiment, includes mechanically coupling the first strap 40 around the torso 22 using the fasteners 46. In an alternative embodiment, the method 400 further comprises mechanically coupling the second strap 50 around the torso 22 using the fasteners 46.

Only two lifting persons 28 are required for transfer. The lifting persons 28 do not require special skills or training to use the sling 10. The lifting persons 28 can be located at the person's back 26 and in front of the person's knee region 24 (as shown in FIG. 1), or alternatively can be located on either side of the person 20. In one embodiment, the lifting persons 28 are located on either side of the person. Each lifting person uses one of the upper or middle handles 54, 56, and one of the lower handles 38 to lift the person 20. In another embodiment, the lifting persons 28 are positioned at the person's back 26 and knee region 24, and one lifting person 28 uses the lower handles 38 and the other lifting person uses the upper handles 54. In other embodiments, the lifting persons 28 can be otherwise positioned around the person 20 and use any combination of the handles 38, 54, 56 to lift the person 20.

In one embodiment, the sling 10 is used to transport the person 20 from a wheelchair to a travel seat (e.g., an airplane seat, a bus seat, or a car seat), or from the travel seat to a wheelchair. In one embodiment, the sling 10 is used to transport the person 20 from a recumbent or other position. For example, the sling 10 can be used to transport the person 20 from a seated or reclining position on the floor, ground, bed, recliner, or any other location. In an alternative embodiment, the sling 10 can be used to transport the person 20 in an emergency evacuation situation from a building. In yet another alternative embodiment, the sling 10 is used to transport the person 20 down a flight or a number of flights of stairs. In one embodiment, the sling 10 is used to transport the person 20 in an emergency rescue situation such as a hurricane, tornado, or flood. In one embodiment, the sling 10 is used in conjunction with other ropes, cables, carabiners, and other safety equipment to lift and transport the person 20. In yet another alternative embodiment, the sling 10 is used to transport the person 20 to a kayak, sit ski, or other recreational seat. The sling 10 can be used to transport a person 20 with physical disabilities, an injured person, an elderly person, or any other person who requires assistance.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. A personal transport device for transporting a person, the device comprising:

a back support;

a first and a second leg flap extending from a bottom edge of the back support, the leg flaps configured to cross under and support a thigh region of a person from a first side to a second side of the thigh region, at least one of the leg flaps including a fastener adapted to couple the first flap to the second flap at or near a knee region of the person;

a first and a second upper handle located on the back support;

a first lower handle located on a first leg flap and a second lower handle located on the second leg flap; and a first strap coupled to the back support and configured to encircle a torso of the person.

2. The device of claim 1 further comprising two middle handles located on the back support and interposed between the upper handles and the leg flaps.

3. The device of claim 2 wherein the middle handles extend at least partially adjacent a side of the person.

4. The device of claim 1 wherein the lower handles are located proximal to the knee region.

5. The device of claim 1 wherein the first strap includes fasteners for mechanically coupling the strap.

6. The device of claim 1 further comprising a rigid elongated support extending from the back support and coupled to a headrest.

7. The device of claim 6 wherein the rigid elongated support comprises a plurality of rigid elongated supports.

8. A personal transport device for transporting a person having a first leg, having a first thigh region, and a first knee region and a second leg, having a second thigh region, and a second knee region, the device comprising:

a flexible support material having a back support region and a plurality of leg extensions;

wherein each leg extension is adapted to define a use configuration in which each leg extension extends from the first thigh region to the second thigh region, thereby crossing under and supporting both thigh regions of the person; and a plurality of handles coupled to the plurality of leg extensions, the handles positioned on the leg extensions such that, in the use configuration, the handles are located adjacent a lateral portion of the first or second knee region, and in the open configuration, the handles extend inwardly toward a longitudinal centerline of the back support region.

9. The device of claim 8 wherein the leg extensions define an open seat region interposed between the leg extensions.

10. The device of claim 8 wherein the leg extensions include fasteners adapted to couple the leg extensions to each other at or near the knee region of the person.

11. The device of claim 8 wherein the back support region and leg extensions include outside edges and the device further comprises edging material extending along at least portions of the edges.

12. The device of claim 8 further comprising two middle handles located on the back support and interposed between the upper handles and the leg extensions, wherein the middle handles extend at least partially adjacent a side of the person.

13. A personal transport device for transporting a person having a first leg, having a first thigh region, and a first knee region and a second leg, having a second thigh region, and a second knee region, the device comprising:

a flexible support material having a back support region and a plurality of leg extensions;

wherein each leg extension is adapted to define a use configuration in which each leg extension extends from the first thigh region to the second thigh region, thereby crossing under and supporting both thigh regions of the person;

a plurality of handles coupled to the plurality of leg extensions, the handles positioned on the leg extensions such that, in the use configuration, the handles are located at or near a lateral portion of the first or second knee region; and a first strap coupled to the back support and configured to encircle the person's torso.

14. The device of claim 13 wherein the first strap includes an upper set of handles.

15. A method of lifting a person using a device having a back support region and a plurality of leg extensions adapted to cross under and support a thigh region of the person, the method comprising:

positioning the back support region adjacent to a back of the person;

pulling and crossing the leg extensions so that each leg extension extends from a first side of a person's thigh region to a second side of the thigh region, thereby crossing under and supporting the thigh region; and lifting the person by applying an upward force to the back support and to each leg extension.

16. The method of claim 15 wherein the method further comprises mechanically coupling the leg extensions at a knee region of the person.

17. The method of claim 15 further comprising mechanically coupling a first strap coupled to the back support region so that the first strap encircles the person's torso.

18. The method of claim 15 further comprising mechanically coupling a second strap coupled to the back support region so that the second strap encircles the person's torso.

19. The method of claim 15 wherein lifting comprises lifting the person using first set of handles coupled to the back support region and a second set of handles coupled to the leg extensions.

20. The method of claim 15 further comprising transporting the person using the first and second set of handles.

21. The method of claim 20 wherein transporting comprises transporting the person from a wheelchair seat to an airplane seat.

22. The method of claim 20 wherein transporting comprises transporting the person from a building.

* * * * *